US007945183B2

(12) United States Patent
Tomiie et al.

(10) Patent No.: US 7,945,183 B2
(45) **Date of Patent: *May 17, 2011**

(54) IMAGE FORMING DEVICE

(75) Inventors: Norio Tomiie, Osaka (JP); Shinki Miyaji, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 370 days.

This patent is subject to a terminal disclaimer.

(21) Appl. No.: 12/286,686

(22) Filed: Oct. 1, 2008

(65) Prior Publication Data

US 2009/0103936 A1 Apr. 23, 2009

(30) Foreign Application Priority Data

Oct. 22, 2007 (JP) ..... 2007-274284

(51) Int. Cl.
*G03G 15/00* (2006.01)
*G03G 15/02* (2006.01)

(52) U.S. Cl. ..... 399/89; 399/50; 399/174

(58) Field of Classification Search ..... 399/50, 399/88, 89, 174, 175
See application file for complete search history.

(56) References Cited

U.S. PATENT DOCUMENTS

| | | | | |
|---|---|---|---|---|
| 4,851,960 | A | 7/1989 | Nakamura et al. | |
| 6,532,347 | B2 | 3/2003 | Watanabe et al. | |
| 2002/0041767 | A1 * | 4/2002 | Saito et al. | 399/44 |
| 2007/0098424 | A1 * | 5/2007 | Okada | 399/50 |
| 2007/0189788 | A1 * | 8/2007 | Hagiwara et al. | 399/44 |

FOREIGN PATENT DOCUMENTS

| | | |
|---|---|---|
| JP | 63-149668 | 6/1988 |
| JP | 2001-201921 | 7/2001 |
| JP | 2007-199374 | 8/2007 |

* cited by examiner

*Primary Examiner* — David M Gray
*Assistant Examiner* — Joseph S Wong
(74) *Attorney, Agent, or Firm* — Jordan and Hamburg LLP

(57) ABSTRACT

An image forming device includes: a high voltage generating circuit for applying an oscillating voltage to a charging member disposed in contact with or proximity to an image carrier, the oscillating voltage having a DC voltage Vdc and an AC voltage Vac superimposed thereon; a current detecting portion for detecting the value of a DC current Idc between the image carrier and the charging member; an AC voltage control portion for controlling the value of the AC voltage Vac so as to secure the detected value of the DC current Idc within a target current range; and an aging control portion for performing rotation driving of the image carrier while securing the AC voltage Vac and the DC voltage Vdc at preset voltage values and setting the frequency of the AC voltage Vac at a frequency different from a frequency during an image forming operation.

12 Claims, 13 Drawing Sheets

| Ambient temperature | Maximum aging time (s) |
|---|---|
| 15°C or higher | 0 |
| 13°C or higher and less than 15°C | 60 |
| 10°C or higher and less than 13°C | 120 |
| 7°C or higher and less than 10°C | 200 |
| 5°C or higher and less than 7°C | 300 |
| 3°C or higher and less than 5°C | 500 |
| Less than 3°C | 800 |

Fig.10

IMAGE FORMING DEVICE

This application is based on an application No. 2007-274284 filed in Japan, the contents of which are hereby incorporated by reference.

BACKGROUND OF THE INVENTION

1. Field of the Invention

The present invention relates to an image forming device including: a high voltage generating circuit for applying an oscillating voltage to a charging member disposed in contact with or proximity to an image carrier, the oscillating voltage having a DC voltage and an AC voltage superimposed thereon; a current detecting portion for detecting the value of a DC current between the image carrier and the charging member; and an AC voltage control portion for controlling the value of the AC voltage so as to secure the detected value of the DC current within a target current range.

2. Description of the Related Art

Charging control devices mounted in recent image forming devices are dominantly of the contact charging system, where a charging member in the form of a roller, a blade, and the like is disposed in contact with or proximity to an image carrier surface, and the charging member is applied an oscillating voltage having a DC voltage and an AC voltage superimposed thereon, thereby uniformly charging the image carrier surface. The contact charging system is in the mainstream because of considerations including the voltage reducing process of reducing the charging control voltage to the image carrier, a reduction in ozone that occurs during charging control, and cost reduction. The oscillating voltage is not limited to a sine wave, but any periodically changing, oscillating wave may be used such as a rectangular wave, a triangular wave, and a pulse wave.

Japanese Unexamined Patent Publication No. 63-149668 discloses charging properties of the contact charging system including the following:

If the AC voltage of the oscillating voltage increases its peak-to-peak voltage, then the charge voltage of the image carrier increases in proportion thereto; if the peak-to-peak voltage reaches a level that is substantially twice the voltage at which the charging starts with the DC voltage, then the charge potential is saturated, and no further voltage increase will change the charge potential; in order to secure charge uniformity, the peak-to-peak voltage of the applied oscillating voltage must be at least twice the voltage at which the charging starts with application of the DC voltage, which is determined by, for example, the properties of the image carrier; and the obtained charge voltage depends on the DC component of the applied voltage.

Japanese Unexamined Patent Publication No. 2001-201921 discloses a technique to prevent problems including deterioration of the image carrier, toner fusing, and image deletion, by securing a constant amount of discharge by preventing excessive discharge irrespective of manufacture variations of resistance of charging members and environment-caused resistance fluctuations.

Specifically, the reference discloses a charge control method that determines the peak-to-peak voltage of the AC voltage applied to the charging member during image formation, on the basis of AC current values measured during a period of time other than image formation, the AC current values including the value of the AC current through the charging member when the charging member has been applied one or more peak-to-peak voltage of less than twice the discharge starting voltage Vth, and the values of the AC current through the charging member when the charging member has been applied two or more peak-to-peak voltages of equal to or more than twice the discharge starting voltage Vth. As used herein, the discharge starting voltage Vth refers to a discharge starting voltage to the image carrier at the time when a DC voltage is applied to the charging member.

More specifically, constant voltage control is carried out such that a peak-to-peak voltage securing fI2 (Vpp)−fI1 (Vpp)=D is determined, where fI1 (Vpp) denotes a function of peak-to-peak voltage and AC current plotted as a line connecting 0 and an AC current value when the charging member is applied one peak-to-peak voltage of less than twice Vth, and fI2 (Vpp) denotes a function of peak-to-peak voltage and AC current plotted as a line connecting AC current values when the charging member is applied two or more peak-to-peak voltages of equal to or more than twice Vth. Then the determined peak-to-peak voltage is rendered a constant peak-to-peak voltage for the AC voltage applied to the charging member during image formation. Note that D is a predetermined constant.

However, it has been found that the technique recited in the JP2001-201921 publication poses the following problems when applied to, for example, an image carrier of 30 mm in diameter with a photoreceptor layer of 20 μm thick amorphous silicon and a charging member made of a charging roller of epichlorohydrin rubber that is contact with the image carrier at a pressure of 1 kgf.

In high-temperature and high-humidity environments, where the electrical resistance of the charging member is relatively low, a desired discharge current value D can be obtained from AC current value properties obtained by the above-described method, whereas in normal-temperature and normal-humidity environments and in low-temperature and low-humidity environments, it is difficult to obtain a desired discharge current value D on the basis of AC current value properties obtained by the above-described method.

In view of this, the Applicants of this application proposed a technique to control the charge potential of the image carrier irrespective of environmental fluctuations such as in temperature and humidity and aging of the image carrier, the charging member, and the like (Japanese Unexamined Patent Publication No. 2007-199374).

Specifically, the Applicants disclosed a charge control device for controlling the output voltage of a high voltage generating circuit for applying an oscillating voltage to a charging member disposed in contact with or proximity to an image carrier, the oscillating voltage having a DC voltage and an AC voltage superimposed thereon, the charge control device including current detecting means of detecting the value of a DC current Idc between the charging material and the image carrier, and DC voltage control means of controlling the DC voltage so as to secure the value of the DC current Idc detected by the current detecting means within a target current range.

When an oscillating voltage is applied to the charging member, and the value of the DC current Idc between the image carrier and the charging material is measured, the DC current Idc and charge potential Vo are proportional to one another, as shown in FIG. 12A, and this relation is proven to show no substantial change due to environmental fluctuations such as in temperature and humidity and aging of the image carrier, the charging member, and the like.

Thus, adjusting the DC current Idc can set the charge potential Vo at a target potential.

The JP63-149668 publication states that when the DC voltage Vdc is equal to or more than the discharge starting voltage Vth, the charge potential Vo is a linear function of the DC voltage Vdc.

On the basis of this statement and the above-described proportional relationship between the DC current Idc and the charge potential Vo, the DC current value Idc is a linear function of the DC voltage Vdc when the DC voltage Vdc is equal to or more than the discharge starting voltage Vth, as shown in FIG. 12B.

The JP63-149668 publication further states that controlling the peak-to-peak voltage of the AC voltage at not less than twice the discharge starting voltage Vth stabilizes the charge potential Vo while the charge potential Vo depends on the applied DC voltage Vdc.

Thus, the DC current Idc can be stabilized at a predetermined current level by setting the DC voltage Vdc at a voltage level (equal to or more than the discharge starting voltage Vth) corresponding to a predetermined charge potential Vo and adjusting the peak-to-peak voltage of the AC voltage to approximately twice the discharge starting voltage Vth, thereby making it possible to set the charge potential of the image carrier at a predetermined, stable charge potential Vo while preventing discharge products that occur due to application of an excessive level of AC voltage.

However, referring to FIG. 13, when epichlorohydrin rubber is employed for the material of the charging member, in a low-temperature environment (low-temperature environment 1 in FIG. 13), the conductive ions inside the epichlorohydrin rubber move slowly resulting in high electrical resistance. In order to adjust the charge potential of the image carrier to the stable target potential, the peak-to-peak voltage of the AC voltage must be controlled at a peak-to-peak voltage Vpp2, which is higher than the peak-to-peak voltage Vpp1 of a normal-temperature environment.

In particular, in a low temperature as extreme as 0° C. (low-temperature environment 2 in FIG. 13), the charge potential of the image carrier cannot be adjusted to the target potential no matter how high the peak-to-peak voltage is made, causing the problem of fog and darkness variations occurring on the formed images.

In view of these circumstances, the present inventors made an attempt to promote the movement of the conductive ions inside the epichlorohydrin rubber and thus lower resistance by executing aging control of performing rotation driving of the image carrier while keeping the AC voltage and the DC voltage applied to the charging member at preset voltage values.

However, the present inventors faced the fact that the aging effect is influenced by the frequency of the AC voltage; when an AC voltage of high frequency is applied, the movement of the conductive ions inside the epichlorohydrin rubber cannot follow the high frequency, resulting in an insufficient aging effect.

In particular, in high speed image forming devices, in order to sufficiently charge the image carrier rotating at high speed, the AC voltage must be set at a high frequency to secure an amount of charge per unit length of the image carrier in its circumferential direction. However, as described above, if the frequency of the AC voltage increases, a sufficient aging effect cannot be obtained at low temperature, making it difficult to overcome the problem of fog and darkness variations occurring on the resulting images.

SUMMARY OF THE INVENTION

In view of the foregoing problems, an object of the present invention is to provide an image forming device capable of controlling the charge potential of the image carrier at a predetermined potential without causing fog and darkness variations on the resulting images even at low environmental temperatures.

An image forming device according to the present invention includes: a high voltage generating circuit for applying an oscillating voltage to a charging member disposed in contact with or proximity to an image carrier, the oscillating voltage having a DC voltage and an AC voltage superimposed thereon; a current detecting portion for detecting the value of a DC current between the image carrier and the charging member; and an AC voltage control portion for controlling the value of the AC voltage so as to secure the detected value of the DC current within a target current range. The image forming device is characterized in including an aging control portion for performing rotation driving of the image carrier while securing the AC voltage and the DC voltage at preset voltage values and setting a frequency of the AC voltage at a frequency different from a frequency during an image forming operation.

The present invention will become more apparent in the detailed description of the preferred embodiments presented below.

BRIEF DESCRIPTION OF THE DRAWINGS

FIG. 10 is a table of ambient temperature;

DESCRIPTION OF THE PREFERRED EMBODIMENTS

A digital copier according to an embodiment of the image forming device of the present invention will be described below.

Figure 2:
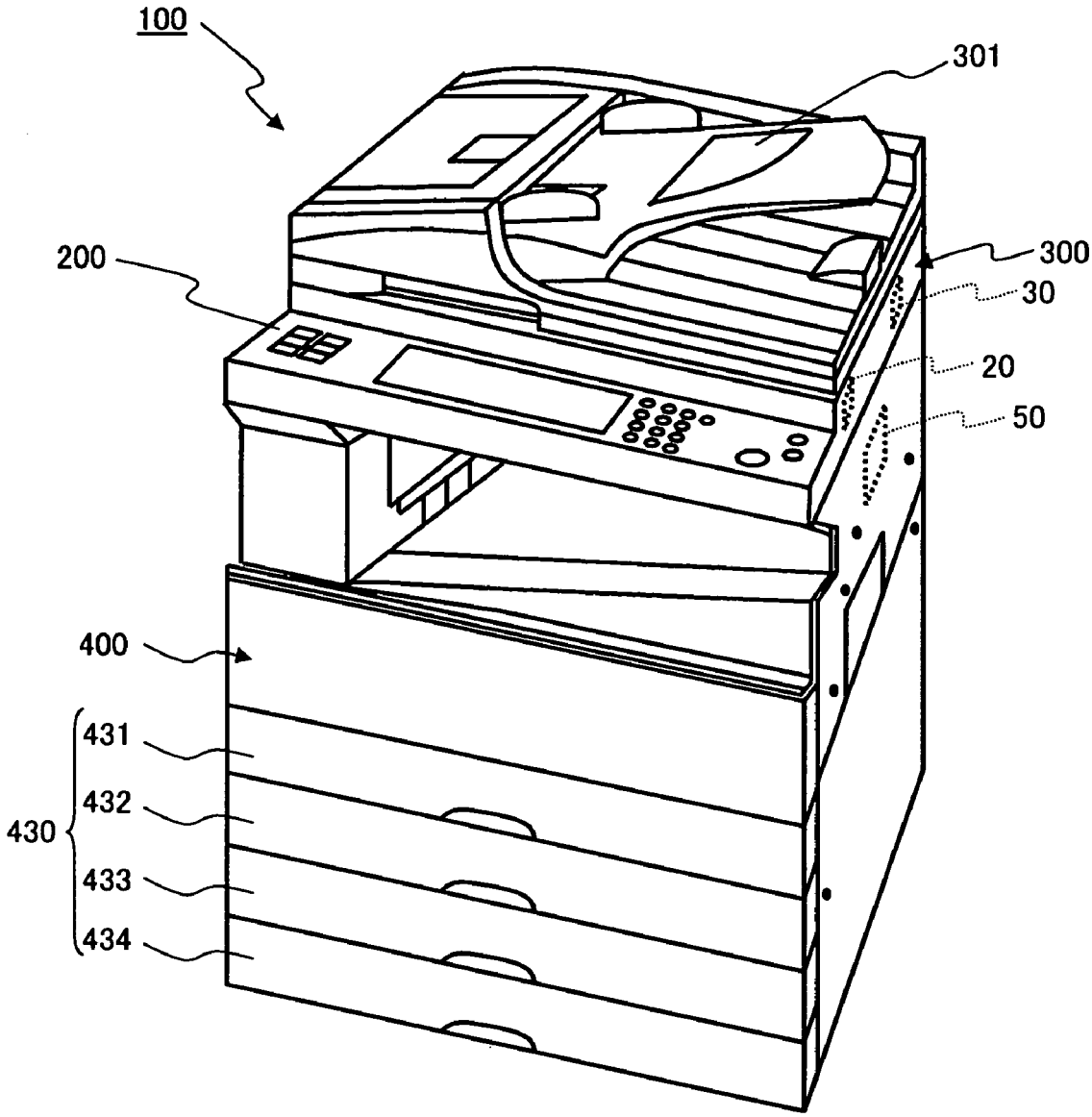
FIG. 2 is a functional block diagram of a digital copier.

Referring to FIG. 2, a digital copier 100 includes functional blocks including an operating portion 200 that serves as a man-machine interface with operators, an image reading portion 300 that reads a document image by photoelectrically converting the document image into image data, and an image forming portion 400 that forms a toner image on a photoreceptor on the basis of the image data read by the image reading portion 300, transfers and fixes the toner image onto a sheet, and outputs the sheet.

The operating portion 200 includes: a touch-panel type liquid crystal display portion that displays, as well as the operational status of the digital copier 100, an operation screen with a plurality of arranged operational software keys;

a plurality of operational hardware keys; and an operating control portion 20 that controls the foregoing.

The image reading portion 300 includes: an automatic document feeder that sequentially feeds sheets placed on a document feeding tray 301; a light source that focuses light onto the document; an imaging element such as CCD that reads the document image by photoelectrically converting reflection light incident from the document through an optical system; and an image reading control portion 30 that controls the foregoing.

Figure 3:
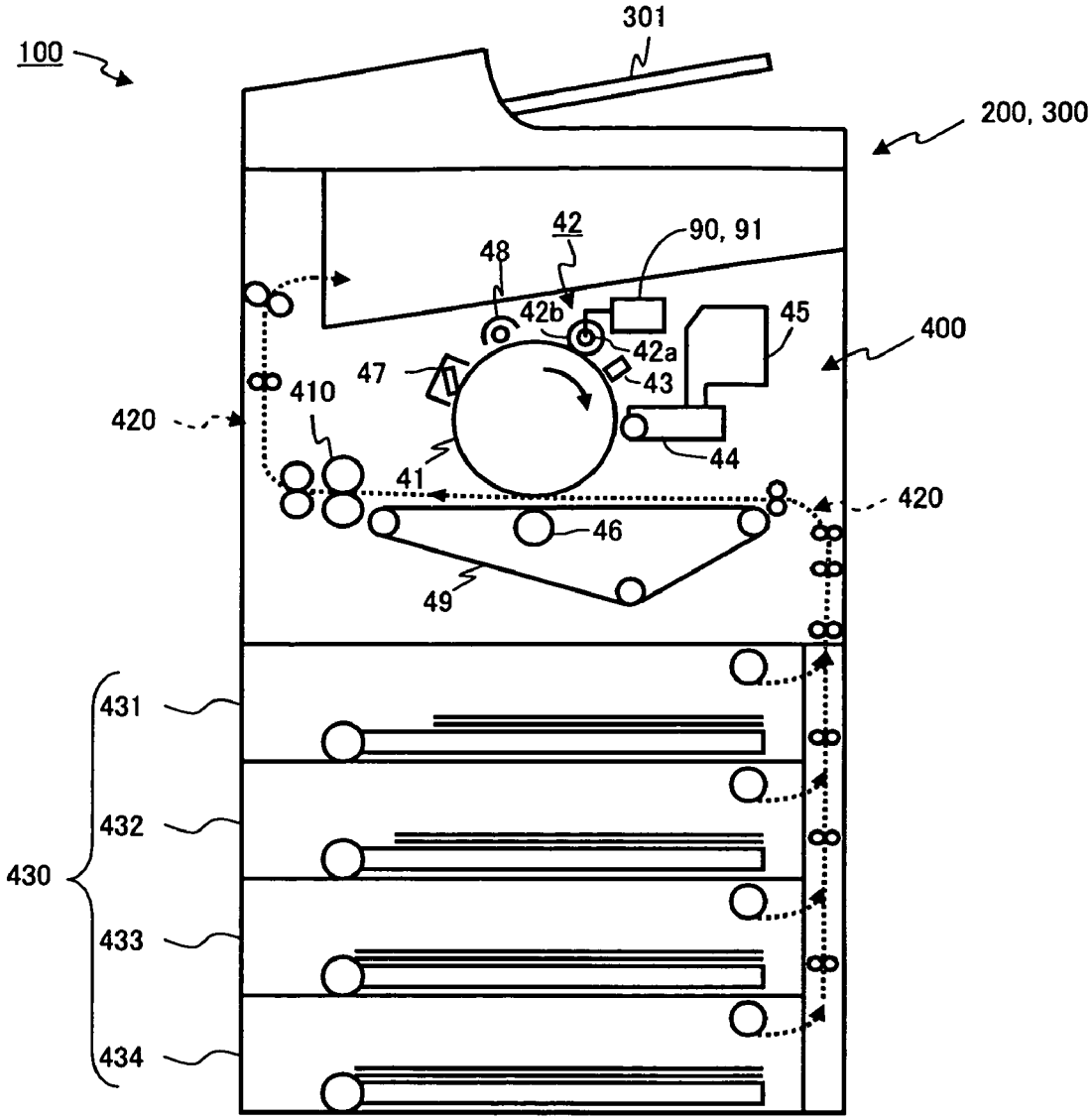
FIG. 3 is a diagram for illustrating an image forming portion.

Referring to FIG. 3, the image forming portion 400 includes an image carrier 41, a charging member 42, a print head 43, a developing device 44, a transfer roller 46, a cleaner 47, and an eraser lamp 48, which are disposed around the image carrier 41 in this order.

The charging member 42 is disposed in contact with the image carrier 41 to subject it to charging treatment. The print head 43 forms an electrostatic latent image onto the image carrier 41 by irradiating it with light on the basis of the image data read by the image reading portion 300. The developing device 44 turns the electrostatic latent image into a visible, toner image by electrostatically fixing to the electrostatic latent image a toner supplied from a toner-filled cartridge 45. The transfer roller 46 transfers the toner image formed on the image carrier 41 to a sheet. The cleaner 47 removes residual toner on the photoreceptor after transfer, and then the eraser lamp 48 discharges residual potential.

The image carrier 41 is composed of an aluminum cylinder and a photoconductive amorphous silicon layer deposited on the surface of the cylinder and exhibiting positive charge properties. The charging member 42 is a charging roller composed of a metal core 42*a* and, as an elastic material, a conductive epichlorohydrin rubber layer 42*b* covering the metal core 42*a*.

The sheet to bear the toner image transferred from the transfer roller 46 is supplied from a paper storage portion 430 composed of a plurality of paper drawers (431-434). The sheet stored in the paper storage portion 430 is fed to the image forming portion 400 through a conveyer mechanism 42 including a plurality of conveyer rollers and a conveyer belt 49.

The transfer roller 46 transfers the toner image formed on the image carrier 41 to the sheet. The toner-bearing sheet is subjected to fixing treatment at a fixing portion 410 including a fixing roller and a pressure roller, and then output. The image forming operation by the image forming portion 400 is controlled by an image forming control portion 40.

The operating control portion 20, the image reading control portion 30, and the image forming control portion 40 are each composed of a micro computer mounting therein a ROM storing a control program and control data and a RAM to serve as a working area, and a control substrate mounting thereon peripheral circuits such as an interface circuit.

Figure 4:
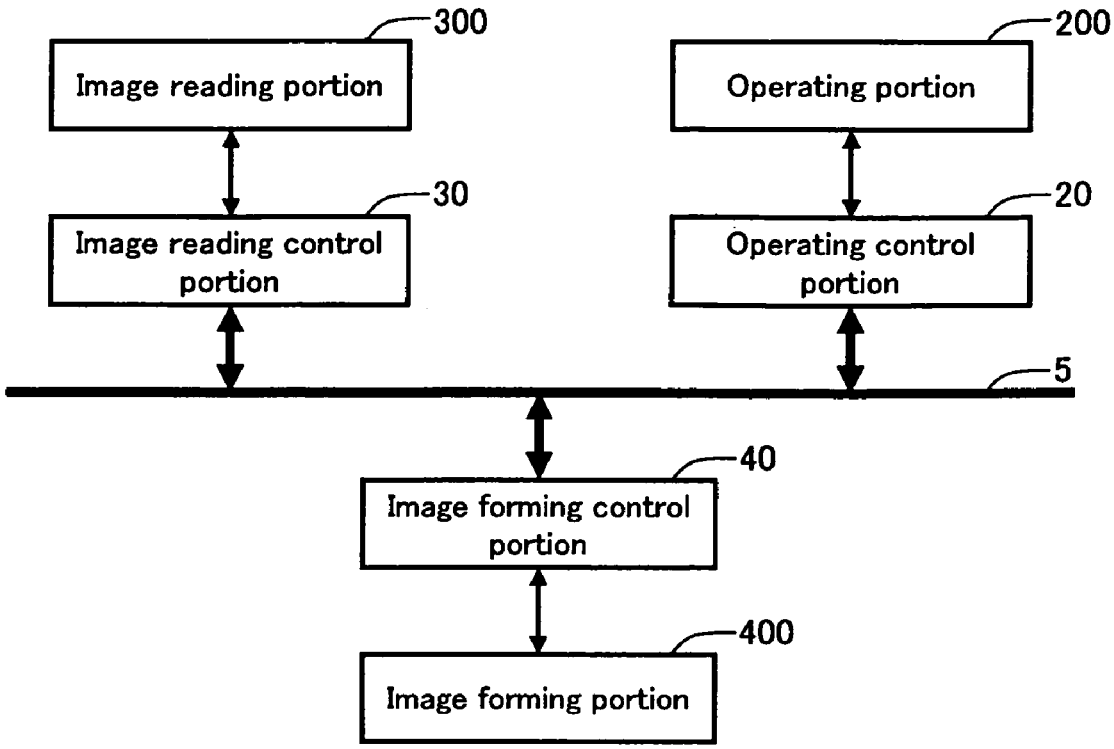
FIG. 4 is a diagram for illustrating control portions.

Referring to FIG. 4, these control portions are connected to each other through a communication bus 5, which mediates between them in exchanging control data necessary for the control that each control portion assumes. The micro computer of each control portion controls its control object on the basis of the control program stored in the ROM.

Figure 1:
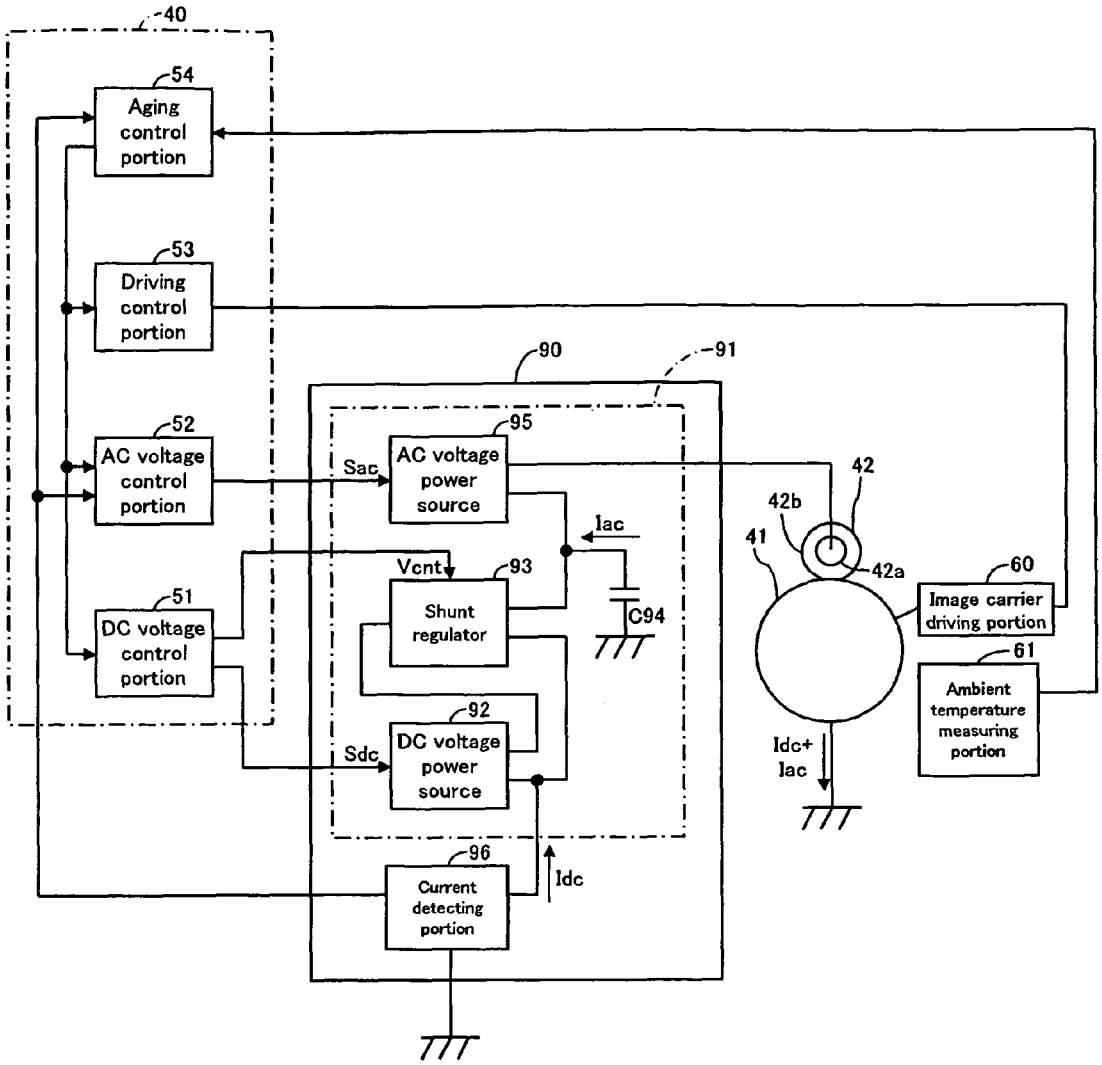
FIG. 1 is a diagram for illustrating an image forming control portion and a high voltage generating circuit.

Referring to FIG. 1, on a substrate 90 provided in the image forming portion 400, a high voltage generating circuit 91 is mounted for charging the image carrier 41 by applying a high voltage to the charging member 42.

The high voltage generating circuit 91 includes a DC voltage power source 92 for outputting a high DC voltage, a shunt regulator 93 coupled to the output terminal of the DC voltage power source 92 and for outputting a predetermined DC voltage Vdc with the use of the high DC voltage, and an AC voltage power source 95 coupled to the output terminal of the shunt regulator 93 and for outputting the DC voltage Vdc input through a capacitor C94 with a superimposed AC voltage Vac.

The image forming control portion 40 includes a DC voltage control portion 51 for controlling the value of the DC voltage Vdc of the high voltage generating circuit 91, an AC voltage control portion 52 for controlling the value of the AC voltage Vac of the high voltage generating circuit 91, and a driving control portion 53 for driving the image carrier 41 at a preset rotational speed through an image carrier driving portion 60.

Figure 5:
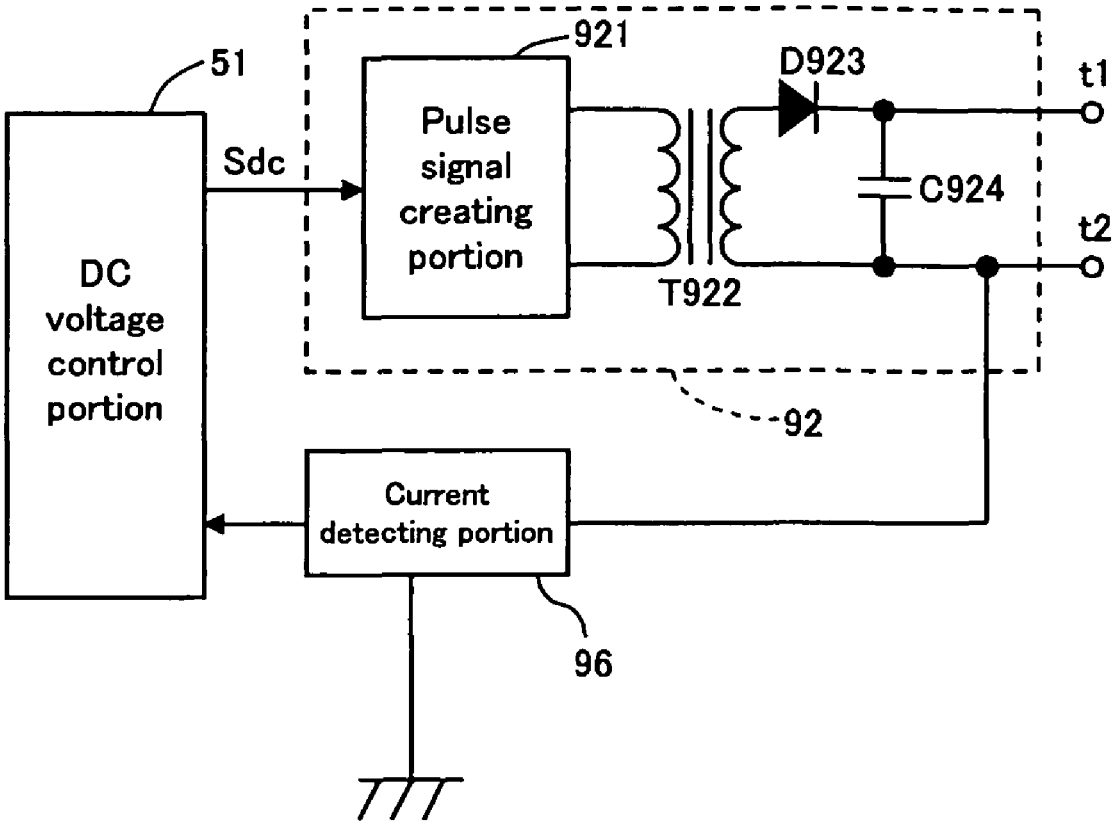
FIG. 5 is a diagram for illustrating a DC voltage power source.

Referring to FIG. 5, the DC voltage power source 92 includes a pulse signal creating portion 921, a pulse transformer T922, and a smoothing circuit.

The pulse signal creating portion 921 outputs a pulse signal on the basis of a remote driving signal Sdc input from the DC voltage control portion 51. The pulse transformer T922 receives on a primary winding a pulse signal input from the pulse signal creating portion 921 and outputs from a secondary winding a high AC voltage enhanced to a predetermined voltage value. The smoothing circuit includes a diode D923 and a capacitor C924 so as to smooth the high AC voltage output from the transformer T922 and output a predetermined high DC voltage.

Figure 6:
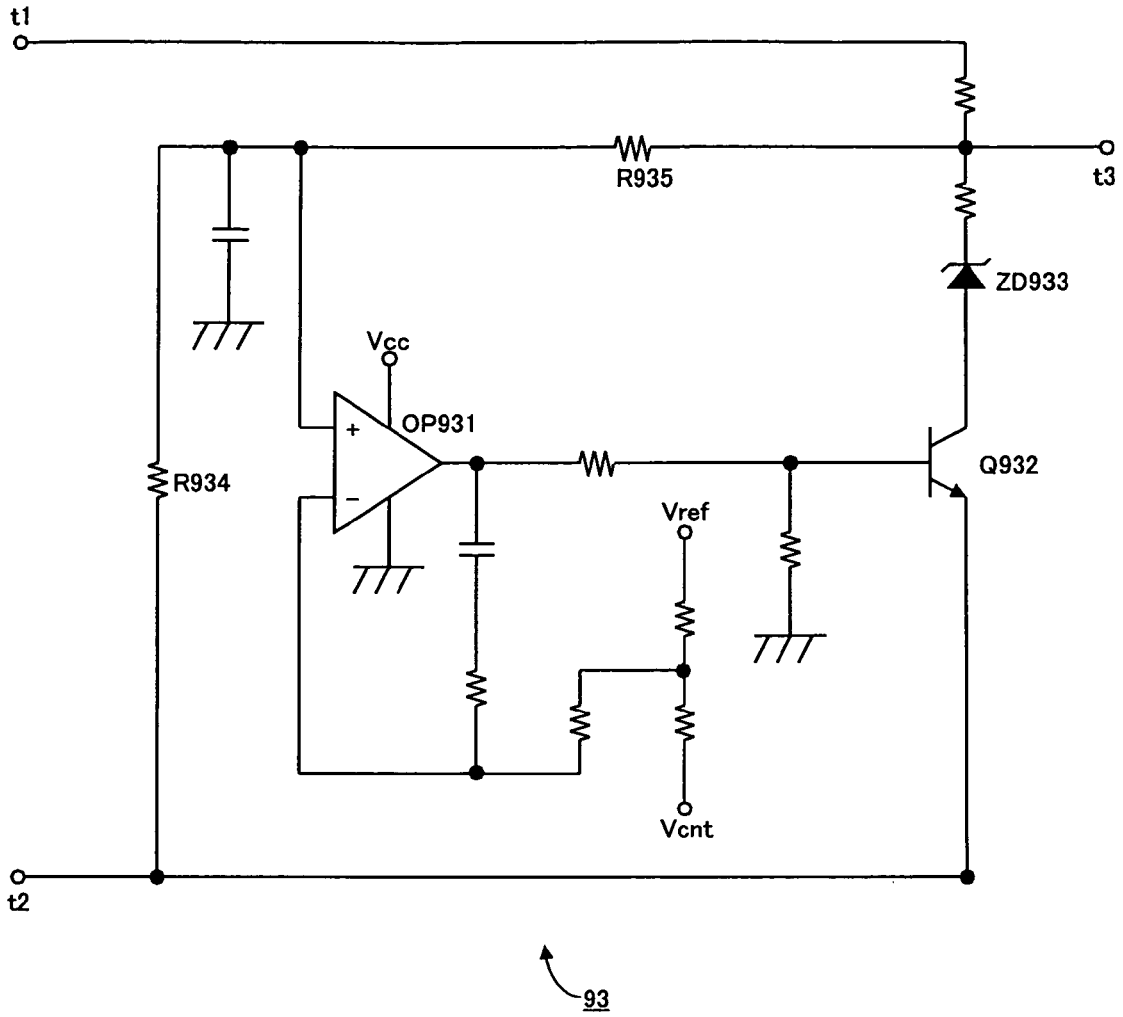
FIG. 6 is a diagram for illustrating a shunt regulator.

Referring to FIG. 6, the shunt regulator 93 includes an operational amplifier OP931 serving as a differential amplifier, a transistor Q932 driven by the output current of the operational amplifier OP931, and a Zener diode ZD933 coupled to the collector of the transistor Q932.

The DC voltage Vdc output from the shunt regulator 93 is divided by resistors R934 and R935, and the divided voltage is input to the non-inverting input terminal of the operational amplifier OP931. A reference voltage is input to the inverting input terminal of the operational amplifier OP931.

Thus, the operational amplifier OP931 supplies a base current to the transistor Q932 in such a manner that the reference voltage and the divided voltage are equal to one another. As a result, the DC voltage Vdc is adjusted by a current through the Zener diode ZD933.

The reference voltage is variable by being adjusted by a comparative voltage Vref set to a fixed value in advance and a control voltage Vcnt controlled by the DC voltage control portion 51.

The image carrier 41 includes a ROM that stores the value of a DC voltage necessary for setting a predetermined charge potential for the image carrier 41. The DC voltage control portion 51 reads the data in the ROM and controls the control voltage Vcnt to adjust the DC voltage Vdc applied to the charging member 42 to the read DC voltage value.

Figure 7:
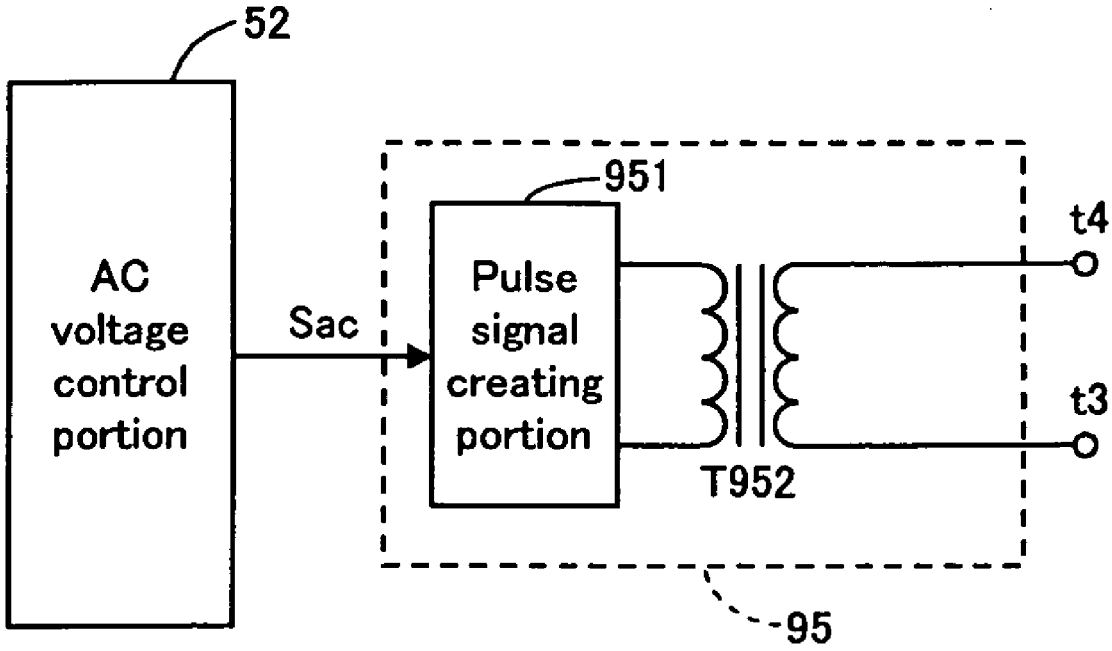
FIG. 7 is a diagram for illustrating an AC voltage power source.

Referring to FIG. 7, the AC voltage power source 95 includes a pulse signal creating portion 951 for outputting a pulse signal on the basis of a remote driving signal Sac input from the AC voltage control portion 52, and a pulse transformer T952 for receiving on a primary winding the pulse signal input from the pulse signal creating portion 951 and outputting from a secondary winding an AC voltage Vac with a desired peak-to-peak voltage.

The AC voltage control portion 52 controls the peak-to-peak voltage of the AC voltage Vac so as to secure the DC current Idc detected by a current detecting portion 96 within a target current range.

The target current range is a predetermined current range around a current value Idc(O) that is set to secure a predetermined charge potential for the image carrier 41, and stored in the ROM of the image carrier 41.

The AC voltage power source 95 receives on the secondary winding side the DC voltage Vdc input from the shunt regulator 93 through the capacitor C94 and outputs an oscillating voltage having the DC voltage Vdc and the AC voltage Vac superimposed thereon.

Figure 8:
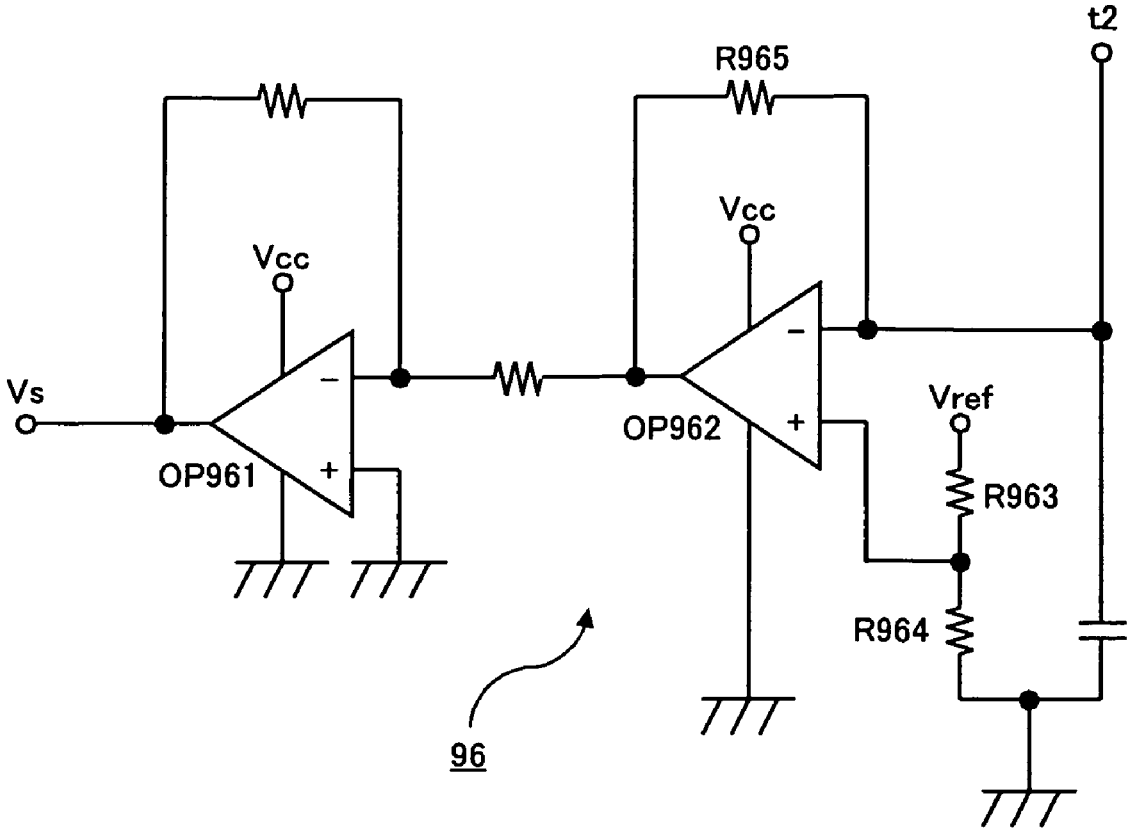
FIG. 8 is a diagram for illustrating a current measuring portion.

The current detecting portion 96 is disposed on the substrate 90 and, as shown in FIG. 8, includes an operational amplifier OP962 for current-voltage conversion and an operational amplifier OP961 for amplification.

The inverting input terminal of the operational amplifier OP962 is coupled to a secondary winding side low voltage terminal t2 of the DC voltage power source 92, and the non-inverting input terminal of the operational amplifier OP962 is coupled to the node of a resistor R963 and a resistor R964. The comparative voltage Vref is divided by the resistor R963 and the resistor R964 and input to the non-inverting input terminal of the operational amplifier OP962 as a reference voltage.

A current flows through a resistor R965 for feedback in such a manner that the reference voltage input to the operational amplifier OP962 and the voltage of the secondary winding side low voltage terminal t2 are equal to one another. This current is converted into a voltage and then output.

This current is a DC current from the charging member 42 to the ground through the image carrier 41, that is, a DC current Idc between the image carrier 41 and the charging member 42. The DC current Idc is converted into a voltage at the operational amplifier OP962 and amplified at the following operational amplifier OP961, and then input to the image forming control portion 40.

During the image forming operation, in order to set the charge potential of the image carrier 41 at a predetermined charge potential, an oscillating voltage is applied to the charging member 42. The DC voltage control portion 51 controls the DC voltage power source 92 and the shunt regulator 93 to output a DC voltage Vdc for setting the discharge starting voltage Vth at the DC voltage value stored in the ROM of the image carrier 41.

The AC voltage control portion 52 controls the AC voltage power source 95 to output an AC voltage Vac with its frequency set at a predetermined one according to a process speed and with a peak-to-peak voltage Vpp of at least twice the discharge starting voltage Vth. In this embodiment, the frequency of the AC voltage Vac during the image forming operation is set at 2.0 [kHz].

The peak-to-peak voltage Vpp, which is used to set the charge potential of the image carrier 41 at a predetermined charge potential during the image forming operation, is determined by a calibration. During the calibration, the driving control portion 53 performs rotation driving of the image carrier 41 at a predetermined rotational speed while the charging member 42 is applied an oscillating voltage having the DC voltage Vdc and the AC voltage Vac superimposed thereon from the high voltage generating circuit 91. The current detecting portion 96 detects the value of the DC current Idc between the image carrier 41 and the charging member 42.

The AC voltage control portion 52 carries out what is called feedback control, i.e., the AC voltage control portion 52 controls the AC voltage power source 95 in accordance with the detected value of the DC current Idc to change the peak-to-peak voltage Vpp of the AC voltage Vac.

Specifically, the AC voltage control portion 52 reads the value of the DC current Idc detected by the current detecting portion 96 and judges whether the read DC current Idc is within the target current range.

When the DC current Idc is within the target current range, the AC voltage control portion 52 keeps the peak-to-peak voltage Vpp at the present value. Otherwise, the AC voltage control portion 52 controls the AC voltage power source 95 to increase the present value of the peak-to-peak voltage Vpp by a preset value when the DC current Idc is below the target current range, or decrease the present value of the peak-to-peak voltage Vpp by a preset value when the DC current Idc is beyond the target current range.

The AC voltage control portion 52 repeats this processing until the DC current Idc is within the target current range. When the DC current Idc is within the target current range, the AC voltage control portion 52 determines the peak-to-peak voltage Vpp at this time as the peak-to-peak voltage Vpp during the image formation operation, and ends the calibration.

However, when the internal temperature, that is, ambient temperature of the digital copier 100 is low, the resistance of the charging member 42 is high, which might hinder a proper calibration because the DC current Idc cannot be secured within the target current range even by adjusting the peak-to-peak voltage Vpp to the maximum output value.

In view of this, the image forming control portion 40 includes an aging control portion 54.

The aging control portion 54 carries out an aging to decrease the resistance of the charging member 42 on conditions presented below, thereby preparing an environment for a proper calibration. Then the calibration is carried out.

A condition for the aging is the case where a proper calibration cannot be carried out, that is, the AC voltage control portion 52 cannot control the DC current Idc within the target current range.

Another condition is the case where a proper calibration is unlikely to be carried out, that is, the ambient temperature of the digital copier 100 is less than a predetermined temperature.

Still another condition is when power is supplied to the digital copier 100 or when the digital copier 100 returns from a power saving mode.

As used herein, the ambient temperature refers to the internal temperature of the digital copier 100. The ambient temperature is measured with an ambient temperature measuring portion 61 that serves as an ambient sensor and is disposed in the vicinity of the charging member 42, and input to the aging control portion 54.

The aging control portion 54 performs rotation driving of the image carrier 41 while securing the AC voltage Vac and the DC voltage Vdc at preset voltage values and setting the frequency of the AC voltage Vac at a frequency different from a frequency during the image forming operation.

Specifically, the aging control portion 54 performs rotation driving of the image carrier 41 at a preset rotational speed through the driving control portion 53, keeps the DC voltage Vdc at the discharge starting voltage Vth through the DC voltage control portion 51, keeps the peak-to-peak voltage Vpp of the AC voltage Vac at approximately three times the discharge starting voltage Vth through the DC voltage control portion 51, specifically at 1.5 [kV], and sets the frequency of the AC voltage Vac at a proper aging frequency that is different from a frequency during the image forming operation.

In this embodiment, the AC voltage control portion 52 sets the frequency of the AC voltage Vac at 1.3 [kHz], which is lower than 2.0 [kHz], which is the frequency during the image forming operation. This promotes the movement of the conductive ions inside the charging member 42, thereby gradually decreasing the resistance thereof.

Figure 9:
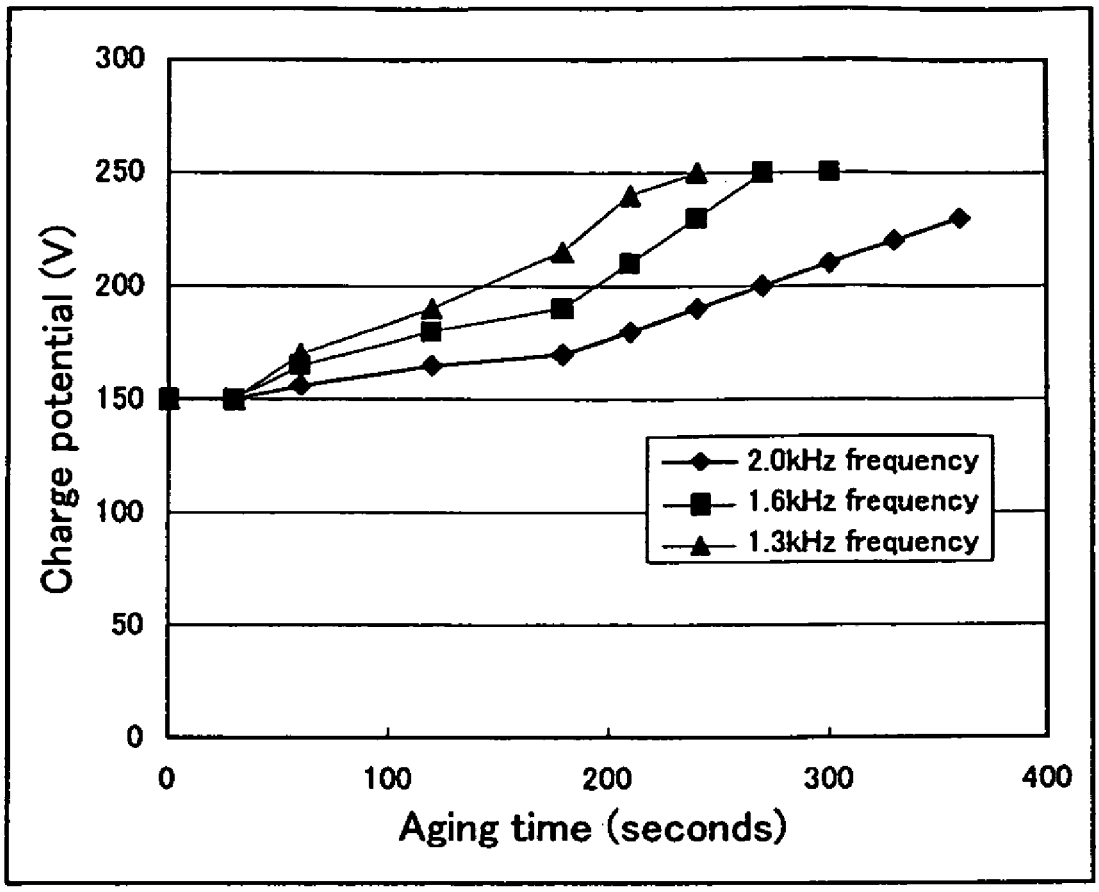
FIG. 9 is a graph of aging time and charge potential.

Referring to FIG. 9, setting the frequency of the AC voltage Vac at a frequency lower than the frequency during the image forming operation speeds up the increase in the charge potential, thereby more rapidly decreasing the resistance of the charging member 42. Note that the frequency of the AC voltage Vac during the aging control is set at a value that is determined in advance experimentally.

The current detecting portion 96 constantly detects the DC current Idc during the operation of the aging control portion 54. When the DC current Idc detected by the current detecting portion 96 reaches the target current range, or after a preset period of time, the aging control portion 54 ends the aging.

The preset period of time is set on the basis of the ambient temperature of the digital copier 100. Specifically, the aging control portion 54, upon input of the ambient temperature measured by the ambient temperature measuring portion 61, refers to table data about ambient temperature stored in the ROM of the image forming control portion 40, e.g., an ambient temperature table shown in FIG. 10, and determines the preset period of time as the largest aging time, which is the longest period of time for which the aging is carried out.

The ambient temperature table shows that since the maximum aging time is "0" at an ambient temperature of 15° C. or higher, the aging control portion 54 does not carry out an aging. At an ambient temperature of less than 15° C., the aging control portion 54 carries out an aging for the maximum aging time corresponding to the ambient temperature set in the ambient temperature table.

This enables the aging control portion 54 to end the aging in a minimized period of time and the image forming control portion 40 to carry out the calibration as early as possible.

Figure 11:
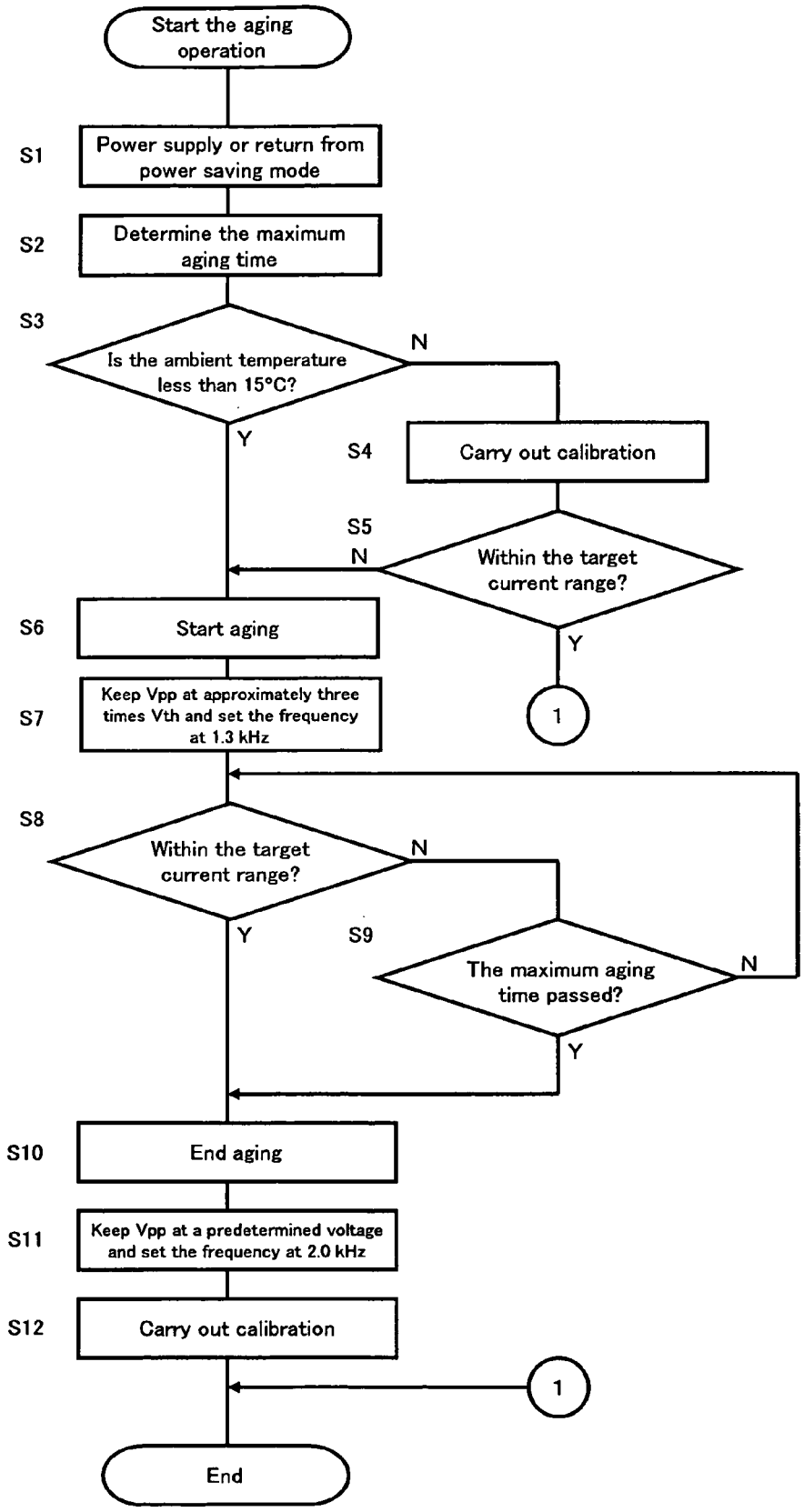
FIG. 11 is a flowchart for describing an aging operation.
Figure 12A:
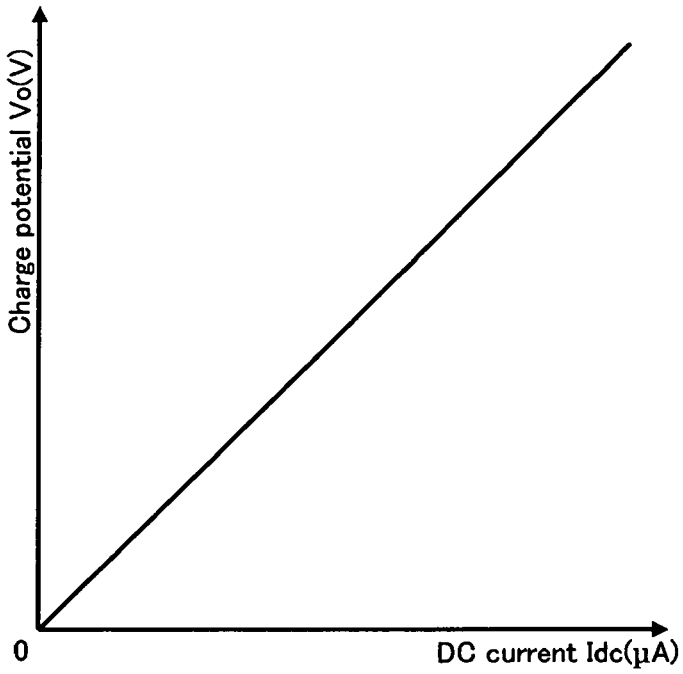
FIG. 12A is a graph of DC current and charge potential.
Figure 12B:
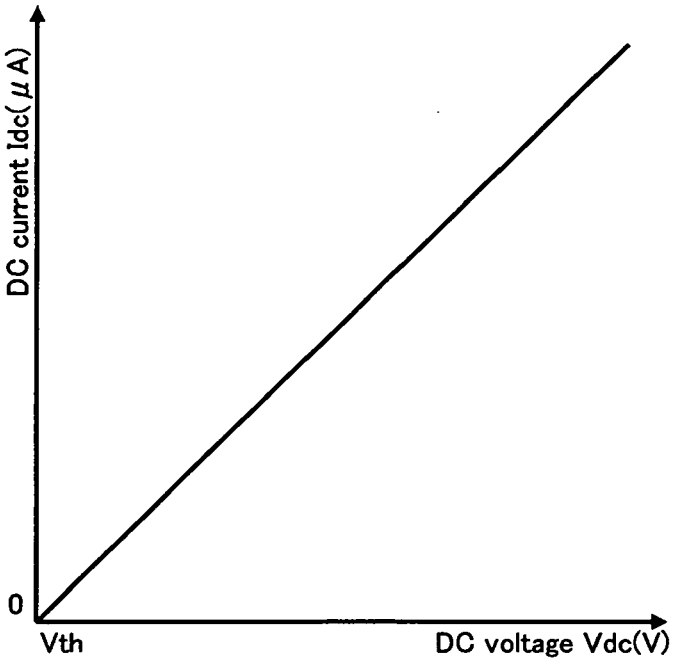
FIG. 12B is a graph of DC voltage and DC current.
Figure 13:
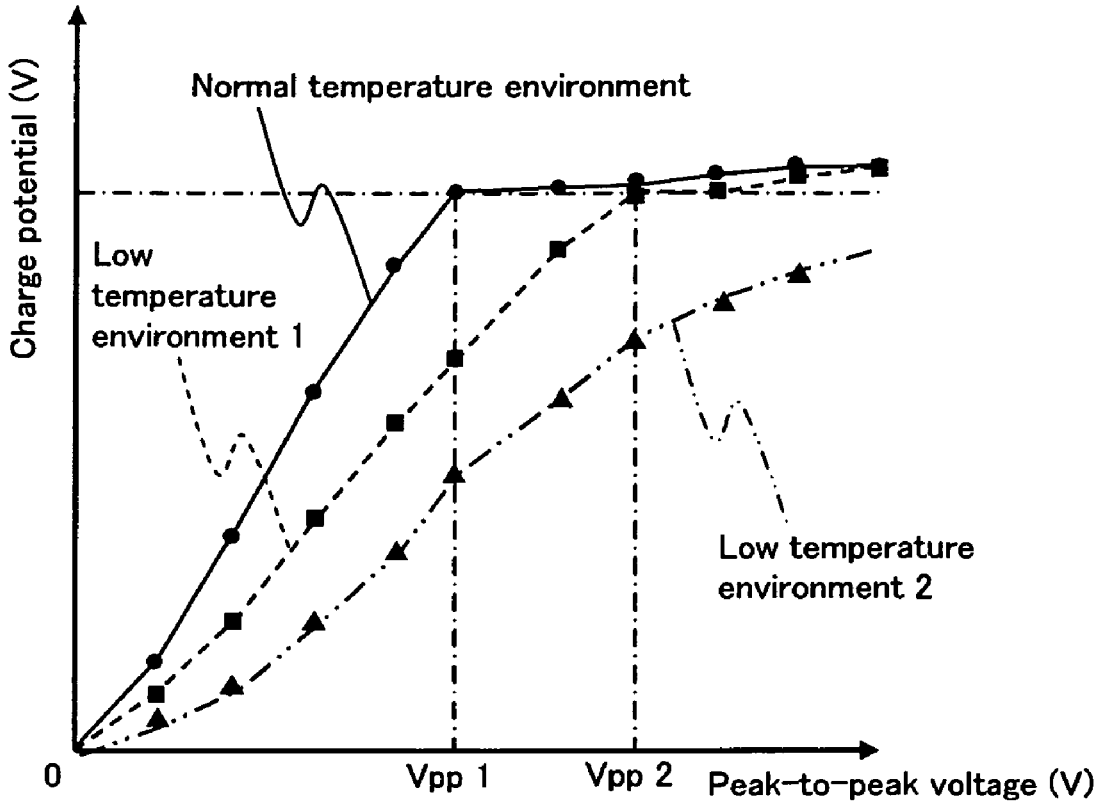
FIG. 13 is a graph showing a relation of peak-to-peak voltage and charge potential according to temperature change.

The aging operation of the digital copier 100 will be described below with reference to a flowchart shown in FIG. 11.

When the digital copier 100 is supplied power or returns from a power saving mode, the aging control portion 54 is actuated to determine the maximum aging time on the basis of the ambient temperature table and the ambient temperature of the digital copier 100 measured by the ambient temperature measuring portion 61 (S1, S2).

When the ambient temperature is 15° C. or higher (S3), at which the maximum aging time is "0", and the image forming control portion 40 carries out a calibration (S4) and the DC current Idc is secured within the target current range (S5), then the peak-to-peak voltage Vpp of the AC voltage Vac at this time is determined as the peak-to-peak voltage Vpp during the image forming operation, and the calibration ends.

When the calibration cannot secure the DC current Idc within the target current range (S5), the aging control portion 54 carries out an aging for a preset period of time, that is, for a maximum aging time (S6). The preset period of time is stored in the ROM that stores the ambient temperature table.

When the ambient temperature is less than 15° C., the aging control portion 54 starts an aging (S6) to apply to the charging member 42 an oscillating voltage having a DC voltage kept at the discharge starting voltage Vth and an AC voltage superimposed on the DC voltage and having its peak-to-peak voltage Vpp kept at approximately three times the discharge starting voltage Vth and its frequency set at 1.3 [kHz]. Also the image carrier 41 is driven and rotated at a predetermined rotational speed.

The aging continues until the DC current Idc is within the target current range or the maximum aging time passes. When the DC current Idc is within the target current range or the maximum aging time passes, the aging control portion 54 ends the aging (S8 to S10).

When the aging ends, the image forming control portion 40 keeps the peak-to-peak voltage Vpp of the AC voltage Vac at a predetermined voltage value and keeps the frequency at 2.0 [kHz], and ends the calibration (S11, S12).

Other embodiments of the present invention will be described below.

While in the above embodiment the digital copier 100 is described as an example of the present invention, the present invention also finds applications in, other than copiers, image forming devices such as printers where the charge potential of the image carrier is set at a predetermined charge potential by the charging member.

While in the above embodiment the preset period of time between the start and ending of the aging by the aging control portion 54 is set on the basis of the ambient temperature of the digital copier 100, the preset period of time may be a constant period of time instead of the ambient temperature-based period of time. This saves the capacity of the ROM for storing the table data where the ambient temperature is set.

While in the above embodiment the image forming device includes the charging member 42 made of a charging roller, the present invention also finds applications in image forming devices where the charging member 42 is made of a blade disposed in contact with or proximity to the image carrier.

The above embodiments have been described by way of example and will not limit the present invention; it will be appreciated that various modifications can be made to the specific details of the constituent parts of the present invention without departing from the scope of the present invention.

What is claimed is:

1. An image forming device having a charging member disposed in contact with or proximity to an image carrier, the image forming device comprising:

a high voltage generating circuit for applying an oscillating voltage to the charging member, the oscillating voltage having a DC voltage and an AC voltage superimposed thereon;

a current detecting portion for detecting the value of a DC current between the image carrier and the charging member;

an AC voltage control portion for controlling the value of the AC voltage so as to secure the value of the DC current detected by the current detecting portion within a target current range; and an aging control portion for performing rotation driving of the image carrier while securing the AC voltage and the DC voltage at preset voltage values and setting a frequency of the AC voltage at a frequency different from a frequency during an image forming operation.

2. The image forming device according to claim 1, wherein the aging control portion sets the frequency of the AC voltage at a frequency lower than the frequency during the image forming operation.

3. The image forming device according to claim 1, wherein the aging control portion is activated when the AC voltage control portion cannot secure the value of the DC current within the target current range, or when an ambient temperature of the image forming device is lower than a predetermined temperature.

4. The image forming device according to claim 1, wherein the aging control portion is activated when power is supplied to the image forming device or when the image forming device returns from a power saving mode.

5. The image forming device according to claim 1, wherein the aging control portion ends an aging when the value of the DC current detected by the current detecting portion reaches the target current range or after a preset period of time.

6. The image forming device according to claim 5, wherein the preset period of time is set on the basis of an ambient temperature of the image forming device.

7. A method for controlling charging of an image forming device having a charging member disposed in contact with or proximity to an image carrier, the method comprising:

a high voltage applying step of applying an oscillating voltage to the charging member, the oscillating voltage having a DC voltage and an AC voltage superimposed thereon;

a current detecting step of detecting the value of a DC current between the image carrier and the charging member;

an AC voltage controlling step of controlling the value of the AC voltage so as to secure the value of the DC current detected in the current detecting step within a target current range; and an aging step of, on a predetermined condition, performing rotation driving of the image carrier while securing the AC voltage and the DC voltage at preset voltage values and setting a frequency of the AC voltage at a frequency different from a frequency during an image forming operation.

8. The method according to claim 7, wherein the aging step sets the frequency of the AC voltage at a frequency lower than the frequency during the image forming operation.

9. The method according to claim 7, wherein the aging step is carried out when the AC voltage controlling step cannot secure the value of the DC current within the target current range, or when an ambient temperature of the image forming device is lower than a predetermined temperature.

10. The method according to claim 7, wherein the aging step is carried out when power is supplied to the image forming device or when the image forming device returns from a power saving mode.

11. The method according to claim 7, wherein the aging step ends an aging when the value of the DC current detected in the current detecting step reaches the target current range or after a preset period of time.

12. The method according to claim 11, wherein the preset period of time is set on the basis of an ambient temperature of the image forming device.

* * * * *